United States Patent [19]

Föhl

[11] 4,122,584

[45] Oct. 31, 1978

[54] LOCK FOR MOTOR VEHICLE SAFETY BELTS

[75] Inventor: Artur Föhl, Schorndorf, Germany

[73] Assignee: Repa Feinstanzwerk GmbH, Aldorf, Germany

[21] Appl. No.: 833,769

[22] Filed: Sep. 16, 1977

[51] Int. Cl.[2] ..... A44B 11/25
[52] U.S. Cl. ..... 24/230 A
[58] Field of Search ..... 24/230 A, 230 AP

[56] References Cited

U.S. PATENT DOCUMENTS

| | | | |
|---|---|---|---|
| 3,029,487 | 4/1962 | Asai | 24/230 A |
| 3,427,694 | 2/1969 | Bullock | 24/230 A |
| 3,534,448 | 10/1970 | Hughes | 24/230 A |
| 3,728,764 | 4/1973 | Carter | 24/230 AP |

FOREIGN PATENT DOCUMENTS

| | | | |
|---|---|---|---|
| 1,193,985 | 6/1970 | United Kingdom | 24/230 A |

*Primary Examiner*—Kenneth J. Dorner
*Attorney, Agent, or Firm*—Herbert L. Lerner

[57] ABSTRACT

Lock for motor vehicle safety belts with a metallic base plate which has a recess in which a latching mechanism is supported so that it can be swung about an axis extending transversely to the insertion direction of a plug-in blade from the closed position by a pushbutton against the action of a spring. With insertion of the plug-in blade the locking mechanism snaps with a latching projection into an undercut of the plug-in blade to the closed position. The recess in the base plate is formed by punching free a lug, which bent out of the plane of the base plate is unitary with and spaced from the base plate forming a guide for the plug-in blade. Manufacture of such locks is simpler with savings in material. In addition the locks are lighter in weight.

4 Claims, 2 Drawing Figures

Fig.1
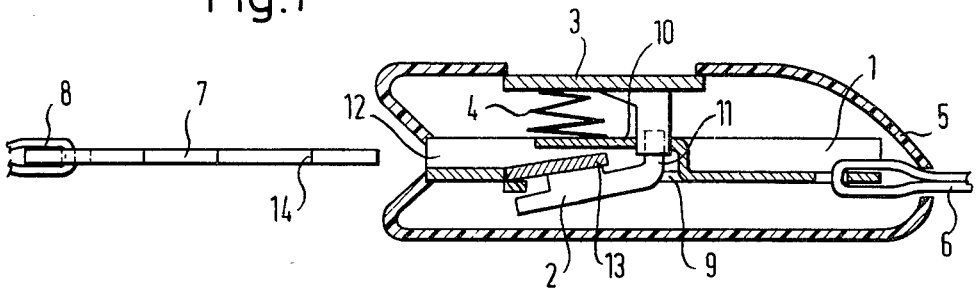
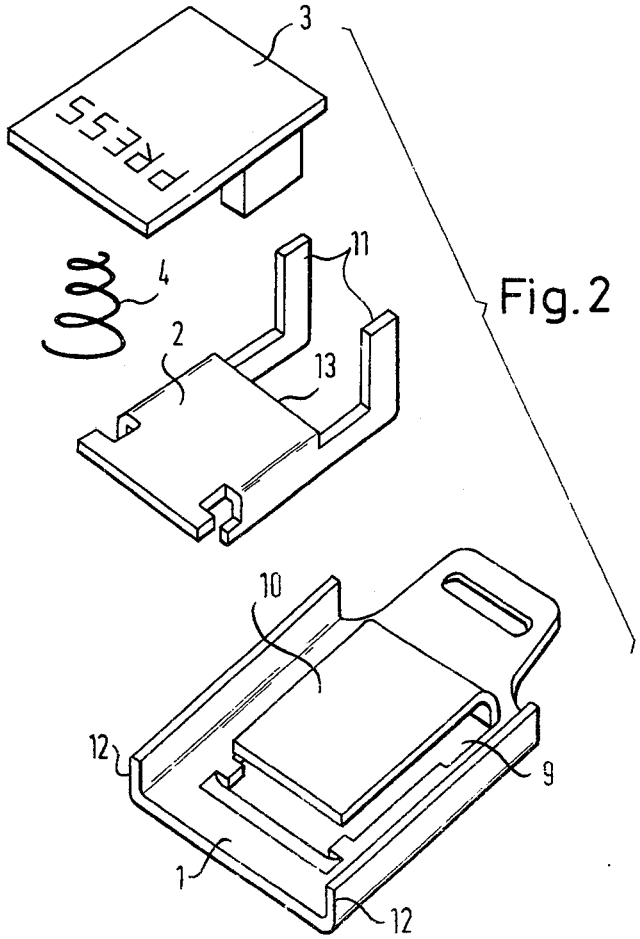
Fig.2

LOCK FOR MOTOR VEHICLE SAFETY BELTS

BACKGROUND OF THE INVENTION

1. Field of the Invention

This invention relates to a lock for motor vehicle safety belts and more particularly refers to a new and improved lock in which pressure on a pushbutton is used to release an inserted plug-in blade latched in the lock.

2. Description of the Prior Art

A lock for motor vehicle safety belts with a metallic base plate which has a recess, in which a latching mechanism is supported so that it can be swung about an axis extending transversely to the insertion of a plug-in blade from the closed position by a pushbutton against the action of a spring is known. In the closed position, a latching projection of the locking mechanism snaps into an undercut of the plug-in blade.

In the known locks of this kind, there is a cover plate in addition to the base plate, the cover plate extending parallel to and spaced from the base plate so that it forms a guide for the plug-in blade.

SUMMARY OF THE INVENTION

It is an object of the invention to provide a lock of the type described which is simplified in such a manner that the cover plate can be dispensed without any adverse effect on the function of the lock.

With the foregoing and other objects in view, there is provided in accordance with the invention a lock for motor vehicle safety belts having a metallic base plate with a recess in which a latching member having a latching projection is supported so that it can be swung from the closed position about an axis extending transversely to the insertion direction of a plug-in blade with an undercut by a pushbutton against the action of a spring, the latching projection of the latching member snapping into the undercut of the plug-in blade upon insertion of the latter to lock the blade, including a recess in the base plate formed by punching free a lug, which bent out of the plane of the base plate is unitary with and spaced from the base plate forming a guide for the plug-in blade.

Other features which are considered as characteristic for the invention are set forth in the appended claims.

Although the invention is illustrated and described herein as embodied in a lock for motor vehicle safety belts, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which:

FIG. 1 shows a side view in cross section of the lock for motor vehicle safety belts; and FIG. 2 is an exploded view of the lock without the housing.

DETAILED DESCRIPTION OF THE INVENTION

The recess in the base plate is formed by punching free a lug which, bent out of the plane of the base plate, forms a guide for the plug-in blade or tongue. The lug is not severed at one end from the base plate but is unitary with and extends from the base plate substantially parallel to the base plate. By punching free and bending out a lug in accordance with the invention, the cover plate, which is required in the known locks, is formed by a part which in those designs is normally waste. In addition to saving material, there is a resultant simplification in production of the locks. Furthermore, the weight of the lock is reduced. The lateral guidance for the plug-in blade or tongue is obtained in a simple manner by angling-off the respective edges of the base plate in the offset direction of the punched-free lug to form a U-shape.

A mechanically simple and therefore, little trouble-prone design is obtained if the latching member, in accordance with a further embodiment of the invention, has on the side facing away from its hinge, extensions projecting beyond the punched-free lug. The extensions are connected to the pushbutton, the latter being arranged parallel to and spaced from the punched-free lug on the side opposite the latching member. The closing spring which is braced, on the one hand, against the surface of the punched-free lug and, on the other hand, against the underside of the pushbutton is disposed in the empty space between the lug and the pushbutton.

An embodiment example of the lock designed in accordance with the invention is depicted in the drawings, where the lock shown in the figures comprises a latching mechanism, which consists of a base plate 1, a latching member 2, a pushbutton 3 and a closing spring 4. The latching mechanism is surrounded by a shell-like housing 5. The base plate 1 is fastened to a belt section 6, while the plug-in blade 7 or tongue, which can be inserted into the lock, is connected to a second belt section 8.

The base plate 1 has in its center a cutout 9 which was formed by punching free a lug 10, which, bent out of the plane of the base plate 1, extends parallel to the base plate 1 at a spacing corresponding generally to the thickness of the plug-in blade 7 and thus forms a guide for the plug-in blade 7, which is inserted into the lock between the base plate 1 and the punched-free lug 10.

A latching member 2, tiltable about its front edge, is supported in the area of the cutout 9. Latching member 2 has extensions 11 which project beyond the punched-free lug 10 and are connected to the pushbutton 3. The extensions 11 are arranged on the side of the punched-free lug 10 opposite the latching member 2 at a spacing.

In the empty space between the punched-free lug 10 and the pushbuttion 3, the closing spring 4 is accommodated. It is braced with one end on the lug 10 and at the other end, against the pushbutton 3 and thereby holds the latching member 2 in the closed position.

For lateral guidance of the plug-in blade 7, the edges 12 of the base plate 2 are raised up in U-fashion.

When the plug-in blade 7 is inserted, the latching member 2 is at first pushed down against the force of the spring 4, until the locking projection 13 of the former snaps into the undercut 14 of the plug-in blade 7. Thereby, a secure latching of the plug-in blade in the latching mechanism is obtained.

For releasing the latch, the pushbutton 3 is moved down against the action of the closing spring 4, whereby the latching projection 13 releases the plug-in blade 7, which is ejected from the lock by an ejection spring, not shown.

There are claimed:

1. In a lock for motor vehicle safety belts having a metallic base plate with a recess in which a latching member having a latching projection is supported so that the latching member can be swung by a pushbutton against the action of a spring, from the closed position about an axis extending transversely to the insertion direction of a plug-in blade, said plug-in blade having an undercut, the latching projection of the latching member snapping into said undercut of the plug-in blade upon insertion of the latter to lock the blade, the improvement comprising a recess in the base plate formed by punching free a lug, which bent out of the plane of the base plate is unitary with and spaced up from the base plate, forming an upper guide for the plug-in blade, and with said latching member inserted in said recess beneath said upper guide.

2. Lock according to claim 1, wherein the lateral edges of the base plate are angled-off in the direction of the lug in U-fashion.

3. Lock according to claim 1, wherein the latching member has on the side opposite its support about which the latching member can be swung, extensions which project beyond the lug and are connected to the pushbutton.

4. In a lock for motor vehicle safety belts having a metallic base plate with a recess in which a latching member having a latching projection is supported so that the latching member can be swung by a pushbutton against the action of a spring, from the closed position about an axis extending transversely to the insertion direction of a plug-in blade, said plug-in blade having an undercut, the latching projection of the latching member snapping into said undercut of the plug-in blade upon insertion of the latter to lock the blade, the improvement comprising a recess in the base plate formed by punching free a lug, which bent out of the plane of the base plate is unitary with and spaced up from the base plate, forming an upper guide for the plug-in blade, and with said latching member inserted in said recess beneath said upper guide, wherein the latching member has on the side opposite its support about which the latching member can be swung, extensions which project beyond the lug and are connected to the pushbutton, and wherein the pushbutton is disposed from and substantially parallel to the lug to provide a space between the lug and the pushbutton, and wherein the closing spring is disposed in the space between the lug and the pushbutton with the spring braced on one side against the lug and on the other side, against the pushbutton.

* * * * *